US007784546B2

(12) United States Patent
Patton

(10) Patent No.: US 7,784,546 B2
(45) Date of Patent: Aug. 31, 2010

(54) TENSION LIFT FRAME USED AS A JACKING FRAME

(75) Inventor: Bart Patton, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 937 days.

(21) Appl. No.: 11/303,102

(22) Filed: Dec. 16, 2005

(65) Prior Publication Data

US 2007/0089884 A1 Apr. 26, 2007

Related U.S. Application Data

(60) Provisional application No. 60/729,087, filed on Oct. 21, 2005.

(51) Int. Cl.
*E21B 19/09* (2006.01)

(52) U.S. Cl. ..... 166/355; 166/350; 405/195.1; 405/196; 114/268

(58) Field of Classification Search ..... 166/350–355, 166/367; 405/158, 195.1, 224, 224.2, 196; 114/268; 212/307, 308
See application file for complete search history.

(56) References Cited

U.S. PATENT DOCUMENTS

| | | | | |
|---|---|---|---|---|
| 3,605,668 | A * | 9/1971 | Morgan | 114/293 |
| 4,421,173 | A | 12/1983 | Beakley et al. | |
| 4,466,487 | A * | 8/1984 | Taylor, Jr. | 166/339 |
| 4,858,694 | A * | 8/1989 | Johnson et al. | 166/355 |
| 5,244,046 | A * | 9/1993 | Council et al. | 166/380 |
| 6,000,480 | A * | 12/1999 | Eik | 175/8 |
| 6,116,345 | A * | 9/2000 | Fontana et al. | 166/343 |
| 6,158,516 | A * | 12/2000 | Smith et al. | 166/385 |
| 6,276,454 | B1 * | 8/2001 | Fontana et al. | 166/343 |
| 6,530,430 | B2 * | 3/2003 | Reynolds | 166/346 |
| 6,554,072 | B1 * | 4/2003 | Mournian et al. | 166/355 |
| 6,554,075 | B2 | 4/2003 | Fikes et al. | |
| 6,688,814 | B2 | 2/2004 | Wetch et al. | |
| 6,763,889 | B2 * | 7/2004 | Rytlewski et al. | 166/338 |
| 6,763,890 | B2 * | 7/2004 | Polsky et al. | 166/360 |
| 6,834,724 | B2 * | 12/2004 | Headworth | 166/384 |
| 7,063,159 | B2 * | 6/2006 | Patton et al. | 166/355 |
| 7,073,592 | B2 * | 7/2006 | Polsky et al. | 166/360 |
| 7,096,963 | B2 * | 8/2006 | Moncus et al. | 166/381 |
| 7,191,837 | B2 * | 3/2007 | Coles | 166/355 |
| 7,219,739 | B2 * | 5/2007 | Robichaux | 166/355 |
| 2004/0151549 | A1 | 8/2004 | Roodenburg et al. | |
| 2005/0077049 | A1 * | 4/2005 | Moe et al. | 166/355 |
| 2005/0211430 | A1 | 9/2005 | Patton | |
| 2006/0016605 | A1 * | 1/2006 | Coles | 166/355 |

FOREIGN PATENT DOCUMENTS

| | | |
|---|---|---|
| GB | 2334048 | 8/1999 |
| GB | 2343466 | 5/2000 |
| GB | 2381548 | 5/2003 |
| GB | 2399838 | 9/2004 |
| GB | 2418684 | 4/2006 |

* cited by examiner

*Primary Examiner*—Thomas A Beach
*Assistant Examiner*—Matthew R Buck
(74) *Attorney, Agent, or Firm*—Rodney Warfford; Michael L. Flynn; Robin Nova

(57) ABSTRACT

An offshore oil well drilling assembly is provided that includes an offshore platform; and a tension lift frame, which supports a coiled tubing injector and a blow out preventer connected thereto and for further connection to a wellhead, wherein the tension lift frame is a free standing assembly that is supported by the platform.

11 Claims, 2 Drawing Sheets

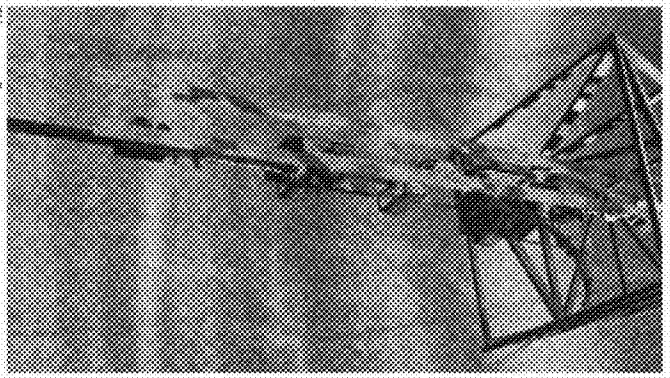
Diagram 2
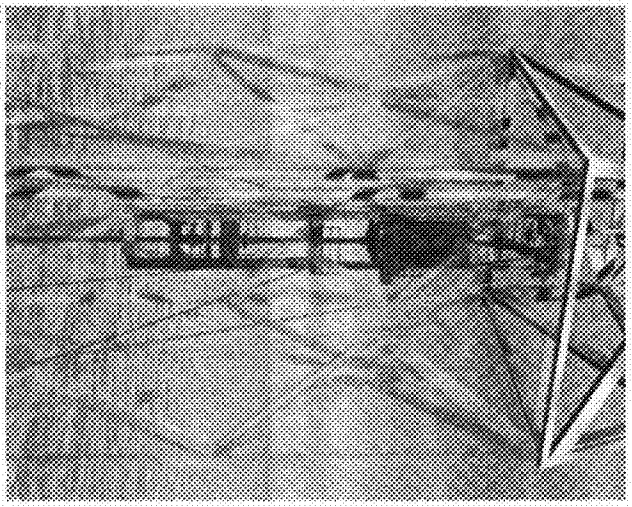
Diagram 3

TENSION LIFT FRAME USED AS A JACKING FRAME

CROSS-REFERENCE TO RELATED APPLICATION

This application claims priority under 35 U.S.C. §119(e) to U.S. Provisional Application Ser. No. 60/729,087, filed on Oct. 21, 2005, which is incorporated herein by reference. This application is also a Continuation-in-Part of 10/809,256, U.S. Patent Application filed on Mar. 25, 2004

FIELD OF THE INVENTION

The present invention relates generally to an oil well offshore platform jacking frame, and particularly to the use of a tension lift frame as a jacking frame, wherein the tension lift frame may be mounted internally or externally to a derrick and may include a heave compensation control device.

BACKGROUND

A jacking frame is a support structure, typically used in offshore drilling operations, which supports a coiled tubing injector and pressure-control equipment attached thereto, such as a blow out preventer. Typical offshore jacking frame structures include a square based frame having single or multiple stackable square frames. These square frames are used to provide the height needed to deploy coiled tubing tools into a wellhead, and to install the blow out preventer units to the coiled tubing injector above the wellhead.

Typically the uppermost box of the jacking frame is capable of lifting the coiled tubing injector head 2-8 feet vertically to compensate for movements of the offshore platform. Such a jacking frame is commonly referred to as a compensated jacking frame, or a heave compensated jacking frame. When needed, additional box sections can be added to increase the overall, or stack-up, height of the jacking frame.

The above described jacking frames are large, bulky structures that tend to take up a considerable amount of space. As such, these jacking frames are too large to be mounted within the mast structure of a derrick, and instead are mounted externally to the derrick, thus occupying a large amount of platform area. Accordingly, a need exists for an improved structure for use as a jacking frame.

SUMMARY

In one embodiment, the present invention is an offshore oil well drilling assembly that includes an offshore platform; and a tension lift frame, which supports a coiled tubing injector and a blow out preventer connected thereto and for further connection to a wellhead, wherein the tension lift frame is a free standing assembly that is supported by the platform.

In another embodiment, the present invention is an offshore oil well as described above wherein the tension lift frame includes vertically extending columns which support the coiled tubing injector and the blow out preventer connected; and a base, which is connected to the columns, and is of a sufficient size and configuration to allow the tension lift frame to be a free standing assembly that is disposed on and supported by the platform.

In yet another embodiment, the present invention is an offshore oil well as described above and further including a derrick supported by the platform; and a compensation system, which transfers a portion of loads from the wellhead to the vertically extending columns, such loads coming from the blow out preventer, the coiled tubing injector and a coiled tubing string, held by the injector; and wherein the tension lift frame is disposed within a mast structure of the derrick.

BRIEF DESCRIPTION OF THE DRAWINGS

These and other features and advantages of the present invention will be better understood by reference to the following detailed description when considered in conjunction with the accompanying drawings wherein:

FIG. 2 is a perspective view of a tension lift frame according to one embodiment of the present invention in use as a tension load path; and FIG. 3 is a perspective view of a dissembled portion of the tension lift frame of FIG. 1.

DETAILED DESCRIPTION OF EMBODIMENTS OF THE INVENTION

Figure 1:
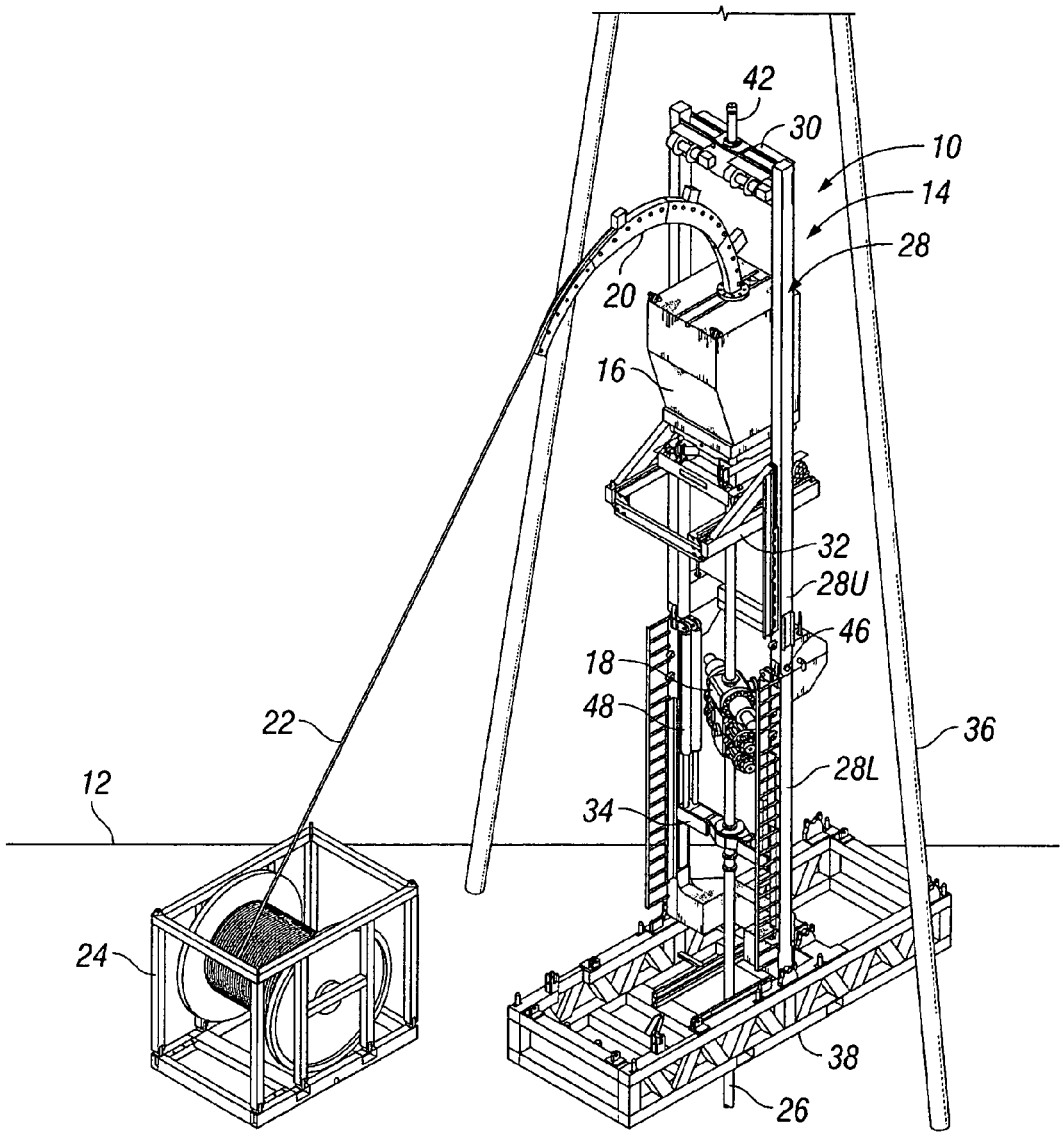
FIG. 1 is a perspective view of a tension lift frame according to one embodiment of the present invention in use as a jacking frame.

As shown in FIGS. 1-3, embodiments of the present invention are directed to the use of a tension lift frame as a jacking frame. In one embodiment, the tension lift frame is mounted within the mast structure of a corresponding derrick, and may include a heave compensation control device.

FIG. 1 shows a tension lift frame 10, according to one embodiment of the present invention, disposed on an offshore drilling platform 12. As shown, the tension lift frame 10 includes a support structure 14, which supports a coiled tubing injector 16, as well as pressure-control equipment attached thereto, such as one or more blow out preventers 18. The blow out preventer 18, in turn, is connectable to a wellhead 26.

As shown in FIG. 1, forming a portion of the coiled tubing injector 16 is a gooseneck 20, which guides a coiled tubing string 22 from a coiled tubing reel 24 to the coiled tubing injector 16. The injector 16 injects the coiled tubing string 22 into the wellhead 26 during a coiled tubing operation, and retrieves the coiled tubing string 22 after the operation is complete.

Unlike the stackable box type jacking frames of the prior art, the support structure 14 of the tension lift frame 10 of the present invention includes a pair of vertically extending columns or mast structures 28. In one embodiment, the frame columns 28 are connected by at least one crossbar 30. Disposed between the columns 28 is a carriage system 32 for supporting the coiled tubing injector 16, as well as a carriage system 34 for supporting the blow out preventer 18. In one embodiment, each carriage system 32 and 34 is movable relative to the columns 28. The compact column arrangement of the tension lift frame 10 allows it to be mounted within a mast structure of a corresponding derrick 36 for use during a coiled tubing operation, as shown in FIG. 1. Alternatively, the tension lift frame 10 may be mounted on the platform 12, external to the mast structure of a corresponding derrick 36.

In one embodiment, the columns 28 of the tension lift frame 10 are connected to a base 38. The base 38 allows the tension lift frame 10 to be a free standing assembly, supported directly by the rig platform 12. However, if desired, guidewires (not shown) may be attached between the tension frame columns 28 and the rig platform 12 to provide additional support for the tension lift frame 10. In one embodiment, the base 38 is rectangular in shape, having a width dimension that is approximately equal to the width dimension of the remainder of the tension lift frame 10. However, in other embodiments, the base 38 may have any appropriate shape and/or size. The frame base 38 may be connected to the frame columns 28 by any appropriate means. For example, in one embodiment the frame base is removably attached to the frame columns 28, by threaded fastening means.

In the above embodiments, the tension lift frame 10 is used as a jacking frame during a coiled tubing operation. However, as shown in FIG. 2, the tension lift frame 10 may also be used as a tension load path. In such a use, the base 38 of the frame 10 is removed and, rather than being supported by the rig platform 12, the frame 10 is suspended from a rig block 40. As shown, an upper crossbar 30 of the tension lift frame 10 includes a lift nubbin 42. The tension lift frame 10 may be suspended from the rig block 40, by connecting the rig block 40 to the lift nubbin 42. This suspended configuration allows a force path to be created from the rig block 40, down the frame columns 28, and to a lower elevator 44, which is connected to the wellhead 26. As such, the components supported by the tension lift frame 10, specifically the coiled tubing injector 16 and the blow out preventer 18, avoid the tension forces that are supported by the frame columns 28.

In one embodiment, the frame assembly 10 includes an upper portion that is pivotally and/or removably connected to a lower portion. For example, in the depicted embodiment of FIG. 1, each column 28 includes a joint 46 which allows the column 28, and hence the frame 10 itself, to be separated into an upper portion 28U and a lower portion 28L. Each upper and corresponding lower portion 28U and 28L are fixedly or removably connected by any one of a variety of means, such as a pin, a threaded fastener, a hinge, or another appropriate fastening means.

In one embodiment, the joint 46 between the upper and lower column portions 28U and 28L is a pivotal joint that allows the upper column portion 28U to be rotated away from the vertical relation to the lower column portion 28L that is shown in FIG. 1. This allows the frame assembly 10 to be compacted, which is sometimes required in order to insert the frame assembly 10 within the mast structure of a derrick.

In the alternative or in addition, the upper and lower column portions 28U and 28L are removably connected, allowing the frame 10 to be disassembled into smaller components that are lighter and easier to transport than the assembled frame 10. In one embodiment, when the frame 10 is assembled (for example as shown in FIG. 1) the coiled tubing injector 16 is supported by the upper column portion 28U and remains connected thereto after the upper column portion 28U has been disconnected from the lower column portion 28L. Similarly, the blow out preventer 18 is supported by the lower column portion 28L when the frame 10 is assembled and remains connected thereto after the upper column portion 28U has been disconnected from the lower column portion 28L. As such, the upper and lower column portions 28U and 28L can be disassembled for ease of transport, and sent to a new platform where installation merely requires reconnecting the upper column portion 28U to the lower column portion 28L. FIG. 3 shows the lower column portion 28L, with the blow out preventer 18 connected thereto, disassembled from the upper column portion 28U and ready for transport.

In one embodiment each lower column portion 28L carries both the blow out preventer 18 and a compensation system 48, which transfers loads from the blow out preventer 18 to the frame 10 while allowing the blow out preventer 18 to move relative to the frame 10. In addition, the compensation system 48 also transfers a portion of the load on the wellhead 26 that is created by the weight and/or movements of the blow out preventer 18, the coiled tubing injector 16, and/or the coiled tubing string 22.

In one embodiment, the compensation system 48 includes a hydraulic cylinder (as shown), a rack and pinion system (not shown), or another appropriate compensation device, located on at least one of the columns 28. For example, in an embodiment where the compensation system 48 includes a hydraulic cylinder, the hydraulic cylinder 48 may be connected between the lower column portion 28U and the blow out preventer carriage 34. Thus arranged, the hydraulic cylinder 48 is adapted to carry the static weight of the blow out preventer 18, the coiled tubing injector 16, and the dynamic weight of the coiled tubing string 22. A typical capacity for such a compensation system 48 is approximately 150,000 pounds. However, the system 48 may be designed or manufactured to support or carry any load which may be encountered during a coiled tubing operation.

In one embodiment, the upper column portion 28U carries the coiled tubing injector 16, and provides a mechanism for transferring the load or pull of the coiled tubing string 22 to the columns 28. In one embodiment, the injector 16 is able to move vertically independently of the blow out preventer 18, while remaining coupled to the blow out preventer 18 during normal coiled tubing operations. This vertical injector motion may be achieved using winches, a rack and pinion drive, chains (either moving chains or as a flexible rack), screws, or any other suitable mechanism.

A bearing arrangement may be needed between the injector carrier 32 and the columns 28 to allow for unimpeded movement. This bearing arrangement may be greased steel on steel, anti-friction pads, rollers, hydrostatic bearings, or another suitable mechanism. Horizontal motion of the injector 16 relative to the upper column portions 28U is accomplished using similar techniques. The injector may also be rotated relative to the upper column portions 28U by use of a bearing or by use of discrete attachment positions. An exemplary bearing for this purpose is a crane slewing bearing having a gear cut on one of its races. A motor may be connected to this gear, allowing the injector 16 to be rotated. An alternative embodiment is a greased steel on steel (or anti-friction padded) bearing coupled to a hydraulic cylinder or a winch, which rotates the injector 16.

Additional features, such as the injector 16 being able to move off of the blow out preventer 18 center line to allow tools to be installed on the coiled tubing string 22 or other services to access the well, winches for moving the injector 16 in and out of the frame 10, etc. may also be used. If the frame 10 is divided into two parts, a winch may be provided to allow the upper part to be placed in the rig blocks and then allow the lower part be pulled up and attached together. This provides a significant safety improvement over current lifting frame operations. Another safety improvement is the ability to transport the injector 16 and blow out preventer 18 within the tension frame 10, or within the upper and column portions 28U and 28L as described above. This eliminates the difficult task of inserting the injector 16 and the blow out preventer 18 into the frame 10 in the derrick or on the offshore platform 12. The fact that the tension frame 10 may be split, or disassembled into two sections allows for the weight to be reduced to manageable levels for the platform cranes.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, spirit and scope of this invention. Accordingly, the foregoing description should not be read as pertaining only to the precise structures described and shown in the accompanying drawings, but rather should be read as consistent with and as support for the following claims, which are to have their fullest and fairest scope.

The invention claimed is:

1. An offshore wellbore assembly comprising:

an offshore platform;

a tension lift frame for connection to a wellhead, wherein the tension lift frame is a free standing assembly that is supported by the platform, and wherein the tension lift frame comprises:

a compensation system which compensates for heave motions from the platform;

vertically extending columns which support a coiled tubing injector and a blow out preventer, wherein the compensation system is connected between one of the vertically extending columns and a blow out preventer carrier, which is movable on the vertically extending columns and supports the blow out preventer, and wherein each column comprises an upper column portion pivotally connected to a lower column portion, allowing the tension lift frame to be compacted for ease of maneuverability during installation of the tension lift frame on the platform; and a base which supports the vertically extending columns, wherein a horizontal cross section of the base defines an area which is larger than an area defined by a horizontal cross section of the vertically extending columns.

2. The assembly of claim 1, wherein the base is of a sufficient size and configuration to allow the tension lift frame to be a free standing assembly that is supported by the platform.

3. The assembly of claim 1, further comprising a derrick supported by the platform, and wherein the tension lift frame is disposed within a mast structure of the derrick.

4. The assembly of claim 1, wherein the compensation system includes at least one hydraulic cylinder.

5. The assembly of claim 1, wherein the upper column portion, supports the coiled tubing injector; and the lower column portion, supports the blow out preventer.

6. The assembly of claim 5, wherein the upper column portion is removably connected to the lower column portion, allowing the tension lift frame to be dissembled into multiple components for ease of transport, and wherein the coiled tubing injector remains connected to the upper column portion and the blow out preventer remains connected to the lower column portion during transport.

7. An offshore wellbore assembly comprising:

an offshore platform; and a tension lift frame comprising:

vertically extending columns which support a coiled tubing injector and a blow out preventer connected thereto and for further connection to a wellhead, a base, which is connected to the columns, wherein a horizontal cross section of the base defines an area which is larger than an area defined by a horizontal cross section of the columns, thus allowing the tension lift frame to be a free standing assembly that is disposed on and supported by the platform;

a compensation system that transfers a portion of loads from the wellhead to the vertically extending columns, such loads coming from the blow out preventer, the coiled tubing injector and a coiled tubing string, held by the injector;

wherein the compensation system is connected between one of the vertically extending columns and a blow out preventer carrier, which is movable on the vertically extending columns and supports the blow out preventer;

wherein each vertically extending column comprises an upper column portion, which supports the coiled tubing injector; and a lower column portion, which supports the blow out preventer; and wherein the upper column portion is removably connected to the lower column portion, allowing the tension lift frame to be dissembled into multiple components for ease of transport, and wherein the coiled tubing injector remains connected to the upper column portion and the blow out preventer remains connected to the lower column portion during transport.

8. The assembly of claim 7, further comprising a derrick supported by the platform, and wherein the tension lift frame is disposed within a mast structure of the derrick.

9. The assembly of claim 7, wherein the compensation system includes at least one hydraulic cylinder.

10. The assembly of claim 7, wherein the upper column portion is pivotally connected to the lower column portion, allowing the tension lift frame to be compacted for ease of maneuverability during installation of the tension lift frame on the platform.

11. An offshore wellbore assembly comprising:

an offshore platform;

a derrick supported by the platform;

a tension lift frame comprising:

vertically extending columns which support a coiled tubing injector and a blow out preventer connected thereto and for further connection to a wellhead, a base which is connected to the columns, and is of a sufficient size and configuration to allow the tension lift frame to be a free standing assembly that is disposed on and supported by the platform, a compensation system that transfers a portion of loads from the wellhead to the vertically extending columns, such loads coming from the blow out preventer, the coiled tubing injector and a coiled tubing string, held by the injector; and wherein the tension lift frame is disposed within a mast structure of the derrick;

wherein the compensation system includes at least one hydraulic cylinder, which is connected between one of the vertically extending columns and a blow out preventer carrier, which is movable on the columns and supports the blow out preventer; and wherein each column comprises an upper column portion pivotally connected to a lower column portion, allowing the tension lift frame to be compacted for ease of maneuverability during installation of the tension lift frame on the platform.

* * * * *